US005104195A

United States Patent [19]

Zaccho

[11] Patent Number: 5,104,195

[45] Date of Patent: Apr. 14, 1992

[54] SELF-PROPELLED APPARATUS FOR CUTTING ASPHALT AND CONCRETE

[76] Inventor: Bo R. Zaccho, Ostermarksvej 12, Bjedstrup, DK-8660 Skanderborg, Denmark

[21] Appl. No.: 613,898

[22] PCT Filed: Jun. 6, 1989

[86] PCT No.: PCT/DK89/00145

§ 371 Date: Dec. 6, 1990

§ 102(e) Date: Dec. 6, 1990

[87] PCT Pub. No.: WO89/12141

PCT Pub. Date: Dec. 14, 1989

[30] Foreign Application Priority Data

Jun. 6, 1988 [DK] Denmark ..... 3061/88

[51] Int. Cl.[5] ..... E01C 23/09

[52] U.S. Cl. ..... 299/39; 51/176; 125/14

[58] Field of Search ..... 299/39; 404/87, 90; 125/13.03, 14; 51/176, 177

[56] References Cited

U.S. PATENT DOCUMENTS

| | | | |
|---|---|---|---|
| 2,673,725 | 3/1954 | Coates | 299/39 |
| 2,701,134 | 2/1955 | Kliepera | 299/39 |
| 2,934,327 | 4/1960 | Lewis | 299/39 |
| 3,045,992 | 7/1962 | Asbury | 299/39 |
| 3,141,702 | 7/1964 | Barton | 299/39 |
| 3,357,745 | 12/1967 | Cooper | 299/39 |
| 3,387,891 | 6/1968 | Simms et al. | 299/39 |

FOREIGN PATENT DOCUMENTS

| | | | |
|---|---|---|---|
| 2119282 | 10/1983 | Fed. Rep. of Germany . | |
| 2558250 | 11/1986 | Fed. Rep. of Germany . | |
| 3543724 | 6/1987 | Fed. Rep. of Germany | 404/90 |

*Primary Examiner*—David J. Bagnell

*Attorney, Agent, or Firm*—Antonelli, Terry Stout & Kraus

[57] ABSTRACT

A self-propelled apparatus for cutting asphalt and concrete which includes a low voltage electric motor for driving support wheels of a carrying frame supporting an engine for driving a cutting blade. A generator is mounted on the carrying frame and is driven by the engine for generating electric power, with an electronic control being connected to the generator for controlling an output of the generator and the supply of power to the low-voltage electric motor so as to control an operation thereof.

3 Claims, 1 Drawing Sheet

SELF-PROPELLED APPARATUS FOR CUTTING ASPHALT AND CONCRETE

FIELD OF THE INVENTION

The present invention relates to a self-propelled apparatus for cutting asphalt and concrete.

BACKGROUND OF THE INVENTION

Self-propelled apparatus for cutting asphalt generally comprise a wheel supported carrying frame including a pair of rear wheels driven by, for example, a belt drive connected to a propelling motor. A petrol or diesel engine is provided with a cutting blade being attached to an output shaft thereof, and with the engine being secured to an engine frame in such a manner so as to enable the cutting blade to be displaceable into an interior of the stationary blade housing.

In, for example, DE-C-2,558,250, a self propelled apparatus for cutting asphalt, concrete and similar materials is proposed; however, the disadvantages of this proposed apparatus resides in the fact that a rather complicated construction is provided which comprises a plurality of cutting blades driven by a common combustion engine which also delivers the propelling force through a mechanically operated variable gear-mechanism.

SUMMARY OF THE INVENTION

The aim underlying the present invention essentially resides in providing a self-propelled cutting apparatus of the aforementioned type which, in operation, may be more easily controlled.

According to advantageous features of the present invention, a self-propelled cutting apparatus is provided which comprises a generator driven by the petrol or diesel engine, with the propelling motor including a low-voltage electric motor controlled by an electronic control unit connected to the generator.

By virtue of the above noted features of the present invention, it is possible to obtain a less complicated cutting apparatus which, in operation, is easier to control with respect to the propelling of the apparatus.

Advantageously, the electronic control unit controls the propelling motor, consisting of a 12/24 volt electric motor, in a continuously and reversible manner, with the electric motor being supplied with energy from the generator at 12/24 volts.

BRIEF DESCRIPTION OF THE DRAWINGS

The invention is described in more detail with reference to the accompanying drawing, wherein.

DETAILED DESCRIPTION

Figure 1:
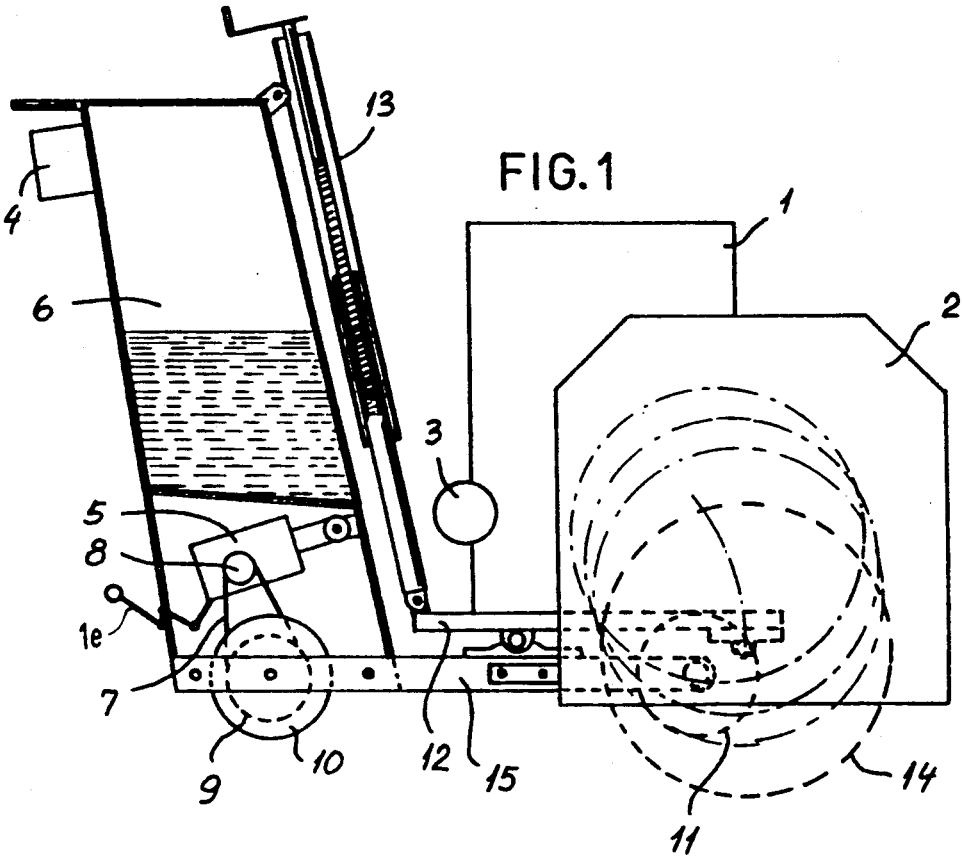
FIG. 1 is a schematic partial cross-sectional side view of an embodiment of a cutting apparatus according to the invention.

The cutting apparatus of the present invention shown in FIG. 1 includes a carrying frame 15 having propelling wheels 10 and front wheels 11 mounted thereon. The propelling wheels 10 are adjustable in order to drive straight relative to the depth of the cutting. A removable water tank 6 is placed on the frame 15, and a spindle and/or a hydraulic piston is also mounted on the frame 15 in order to enable an adjustment of a height of a cutting blade 14 during a cutting operation and when the cutting operation is finished. The water tank 6 and a protection housing 2 for the cutting blade 14 are removable so that the cutting apparatus components may advantageously be packed as separate assembly units.

Figure 2:
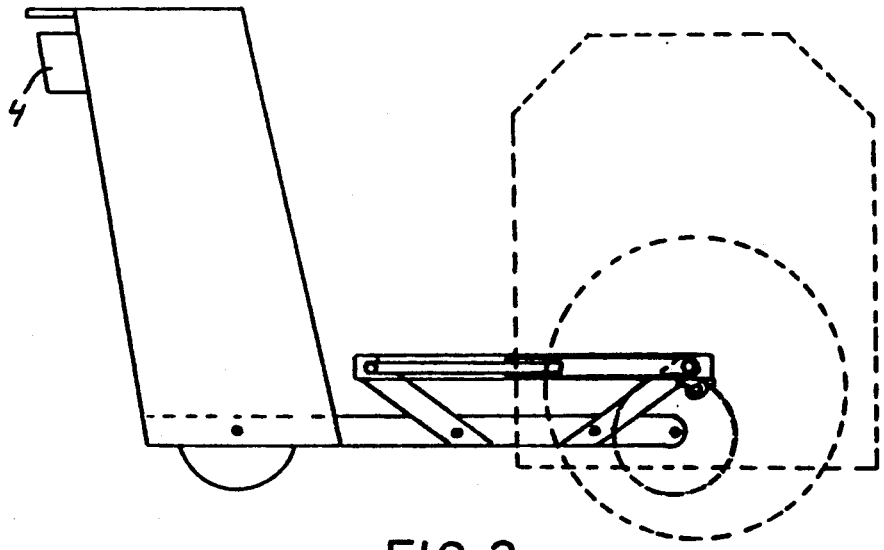
FIG. 2 is a schematic side view of an alternative embodiment of an elevation system for the engine and cutting blade in a cutting apparatus according to the invention.

The cutting blade housing 2 is secured to the stationary carrying frame 15, with the cutting blade 14 and a petrol or diesel engine 1 being mounted on an engine frame 12. The engine frame 12 may be mounted so as to be tiltable on two bearings or may be elevated by a jaw-tongs-mechanism such as shown in FIG. 2.

The self-propelling apparatus is propelled by a 12/24 volt generator 3 driven by the engine 1, with the generator 3 supplying electric power to an electronic continuously controlled regulator 4 which supplies electric power to a 12/24 volt electric propelling motor 5. The propelling force from the electric motor 5 is transmitted to the propelling wheels 10 by a belt drive system 7, 8, 9. The electric motor 5 may be pivoted downwardly to loosen the driving belt by displacement of the handle 1*e* shown in FIG. 1 to enable an uncoupling of the wheels 10.

The self-propelled asphalt and concrete cutting apparatus according to the invention may range in size from 120 to 350 kg with a petrol or a diesel engine. It is of great importance that the cutting blade 14 is completely protected during operation so that injury to an operator of the apparatus by the cutting blade 14 is prevented. The shown and described cutting apparatus meets the strongest security requirements from the labor inspection authorities. The electronic controlled regulator 4 has advantage that the cutting apparatus may also be operated by unskilled persons.

I claim:

1. A self-propelled apparatus for cutting asphalt and concrete, the apparatus comprising:

a petrol or diesel engine;

an engine frame means for supporting said engine;

a carrying frame means for supporting said engine frame means;

a pair of support wheels mounted on said carrying frame means;

a motor means for driving said support wheels;

a belt drive means for transmitting drive power from said motor means to said support wheels;

a cutting blade means connected to an output shaft of said engine;

at least one of a piston means and spindle means for enabling a height adjustment of the engine frame means with respect to the carrying frame means;

housing means mounted on said carrying means for accommodating said cutting means;

means for mounting said engine frame means on said carrying frame means so as to enable said cutting blade means to be displaceable into and out of said housing means;

generator means mounted on said carrying frame means driven by said engine for generating electric power; and electronic control means connected to said generator means for controlling an output of said generator means;

wherein said motor means is a low-voltage electric motor controlled by said electronic control means.

2. A self-propelled apparatus for cutting asphalt and concrete as claimed in claim 1, wherein the motor means is a 12/24 volt electric motor, said generator means is adapted to supply 12/24 volts, and wherein said electronic control means controls said motor means in a continuous and reversible manner.

3. A self-propelled apparatus for cutting asphalt and concrete according to claim 2, further comprising means for mounting said motor means on said carrying frame means so as to enable the motor means to be pivoted relative to said carrying frame means to uncouple said belt drive means.

* * * * *